US005676585A

United States Patent [19]

Nuermberger, III et al.

[11] Patent Number: 5,676,585

[45] Date of Patent: Oct. 14, 1997

[54] TOY VEHICLE HAVING A HINGED CHASSIS

[75] Inventors: Carl H. Nuermberger, III, Buffalo; Walter A. Sobieraj, Williamsville, both of N.Y.

[73] Assignee: The Smalltime Toy Company, Inc., Amherst, N.Y.

[21] Appl. No.: 501,325

[22] Filed: Jul. 12, 1995

[51] Int. Cl.[6] ..... A63H 17/06; A63H 17/26

[52] U.S. Cl. ..... 446/428; 446/424; 446/470

[58] Field of Search ..... 446/428, 427, 446/425, 433, 466, 469, 470, 471, 465, 434

[56] References Cited

U.S. PATENT DOCUMENTS

| | | | |
|---|---|---|---|
| 2,738,617 | 3/1956 | Capehart | 446/278 |
| 3,738,701 | 6/1973 | Holloway | 446/428 X |
| 4,516,948 | 5/1985 | Obara | 446/376 X |
| 4,516,952 | 5/1985 | Brand et al. | 446/427 |
| 4,626,223 | 12/1986 | Sweet | 446/470 X |

*Primary Examiner*—Mickey Yu

*Attorney, Agent, or Firm*—Phillips, Lytle, Hitchcock, Blaine & Huber

[57] ABSTRACT

A toy vehicle (10) emulating more than one function of an adult vehicle utilizes a novel chassis. The chassis includes at least two portions (11 and 12) hinged together at a pivot rod (13). The pivot rod may be raised or lowered placing the toy vehicle in at least a first and second position. The toy vehicle may perform one function in its first position and a second function in its second position, each junction emulating the actions performed by an adult work vehicle. A stop (25) is incorporated to the chassis to define maximum and minimum positions for the pivot rod.

18 Claims, 6 Drawing Sheets

TOY VEHICLE HAVING A HINGED CHASSIS

TECHNICAL FIELD

The present invention relates generally to toys emulating the functionality of full-size adult vehicles, and, more particularly, to toy vehicles emulating at least two functions of full-size adult work vehicles, the operability of each function selected by the positioning of a hinged chassis.

BACKGROUND

Toy vehicles are ubiquitous. Scale miniatures of vehicles operated by adults have always attracted the attention of children. The more accurate a vehicle reproduction is, the more appealing it is to a child. Most appealing to a child is the reproduction which replicates the functionality of a full-size adult vehicle.

Functional replicas of almost every vehicle type are known. These include dump trucks (U.S. Pat. No. 2,691,244 DUMP TRUCK to Steinke), tow trucks (U.S. Pat. No. 3,643,372 TOY TOW TRUCK to Nash et al) and loaders (U.S. Pat. No. 3,911,615 TOY SCOOP LOADER to Alexander). Each vehicle listed above teaches children intuitive mechanical reactions. For example, in Alexander, arms support a bucket on their forward ends and a handle between their rearward ends forming a frame. The frame is intermediately pivoted about an axis. When the child grasps the handle and forces rotation, the entire frame rotates about the pivot. The mechanical reaction is straight forward and easy for a child to understand. However, there is a lack of children's toys operating on counter-intuitive mechanical reactions, where rotation of one item causes opposite rotation of a second item. In addition, most functional reproductions are operable only through the use of two hands. For instance, to ensure the tow truck in Nash does not slide or flip over when force is applied downward on the boom, the child must hold the tow truck steady with his free hand.

Therefore, the present invention provides toy vehicles easily operated with one hand which allow a child to explore and discover counter-intuitive mechanical reactions.

DISCLOSURE OF THE INVENTION

Figure 1:
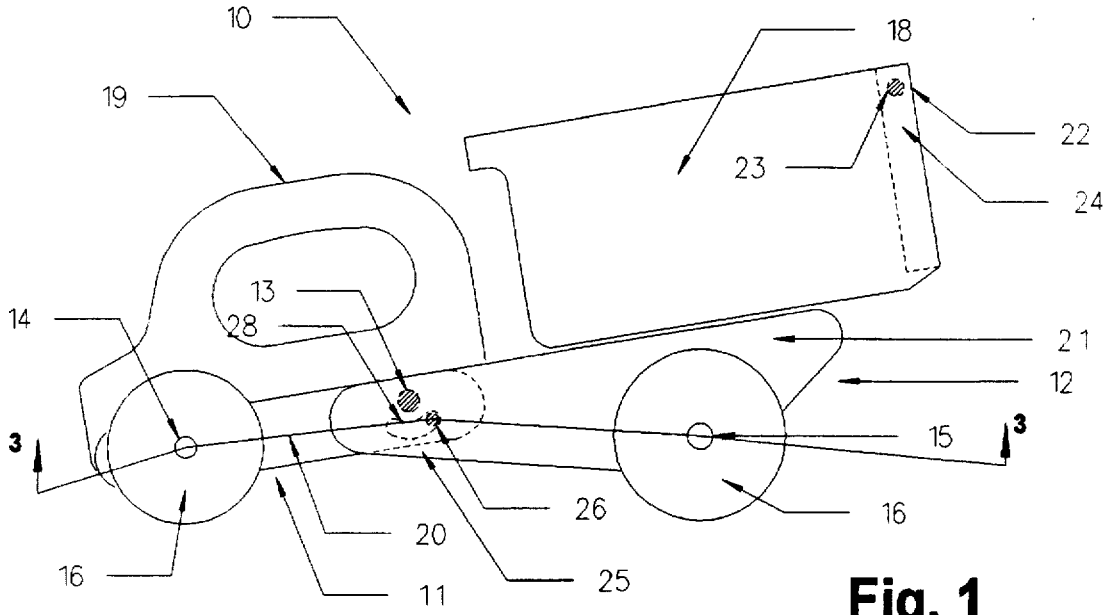
FIG. 1 is a side elevation, partially in section, of a toy dump truck in its transporting position.

With parenthetical reference to the various drawing figures, the present invention is a toy vehicle based on a novel chassis. The chassis has a plurality of articulated members (20 and 21) forming chassis portions (11 and 12) and joined by at least one pivot rod (13) acting as a hinge. The chassis is supported at a plurality of locations by well known supports (e.g., wheels (16) and treads). The toy vehicle has a work device (18) which emulates at least two functions of the adult vehicle it replicates (e.g., for a dump truck: (1) holding material, and (2) dumping material). The hinge is specially configured to move upward and downward through a first position (shown in FIG. 1) and a second position (shown in FIG. 2). When the hinge is in the first position, a first function of the work device of the replicated adult vehicle is operable, and when the hinge is in the second position, a second function of the work device of the replicated adult vehicle is operable.

It is also contemplated the toy vehicle may include means for limiting the movement of the hinge. In one embodiment, the two chassis portions overlap, one having a recess (28) and the other having a rod (26) adapted to slide within and along the recess. The movement of the hinge is limited by the rod abutting either end of the recess. In another embodiment, a flange (45) is provided on one chassis member (42). Downward movement is stopped when the other hinged chassis member (41) abuts the flange. The upward motion of the hinge is stopped when another portion of the vehicle (46) abuts the surface supporting the vehicle.

Accordingly, the general object of the invention is to provide a toy vehicle that is a reproduction of a full-size adult vehicle able to emulate at least two functions of the replicated adult vehicle.

Another object is to emulate the functionality utilizing counter-intuitive mechanical reactions based on a specially configured hinged chassis.

Another object is to provide a toy vehicle easily operated by one hand.

Still another object is to limit the motion of the hinged chassis between a maximum and minimum position.

DESCRIPTION OF THE PREFERRED EMBODIMENT

At the outset, it should be dearly understood that like reference numerals are intended to identify the same structural elements, portions or surfaces consistently throughout the several drawings figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Figure 2:
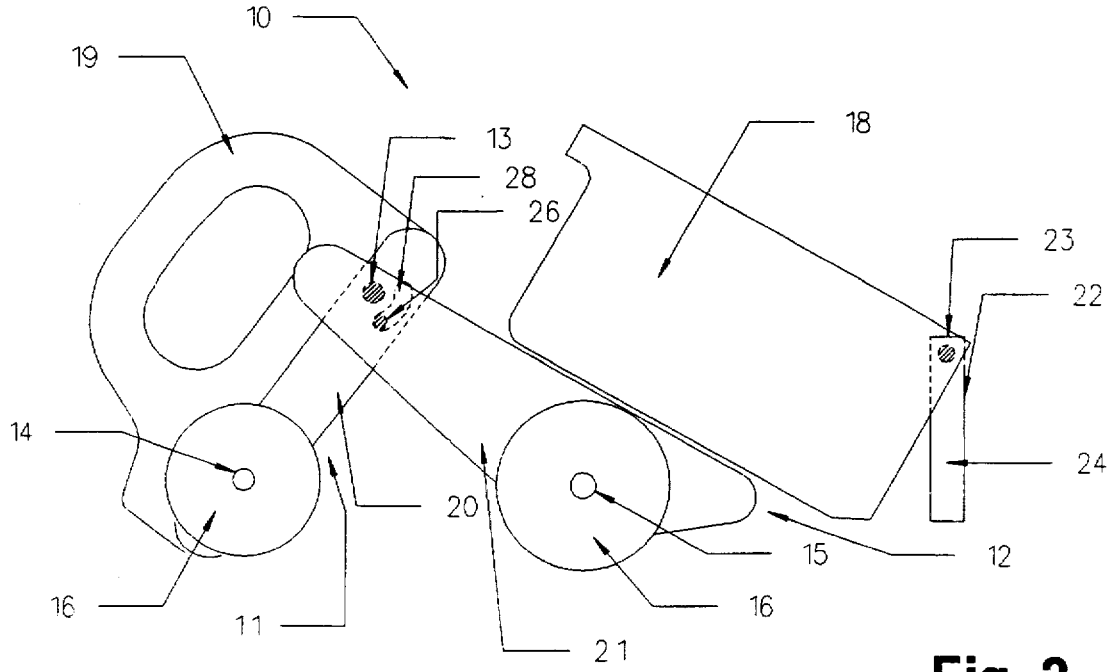
FIG. 2 is similar to FIG. 1 except the dump truck is in its dumping position.
Figure 3:
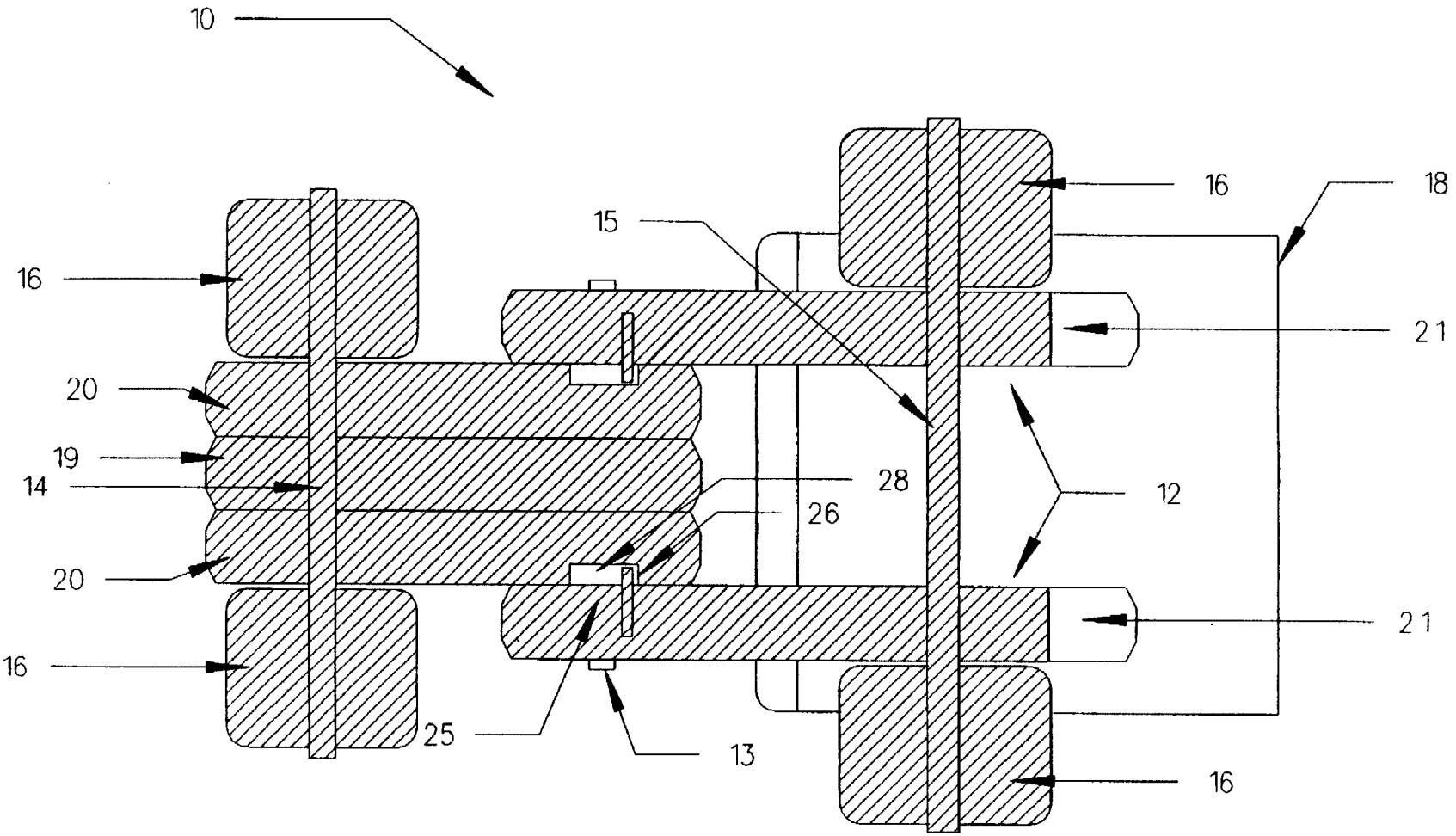
FIG. 3 is a sectional view of the dump truck in its transporting position taken along line 3—3 in FIG. 1.

Referring now to the drawings, and particularly FIGS. 1–3, dump truck 10 is shown to broadly comprise forward chassis portion 11, rearward chassis portion 12, pivot rod 13, axles 14 and 15, wheels, severally indicated at 16, work device container 18 and handle 19.

Chassis portion 11 comprises identical members 20 on either side of handle 19. Members 20 and handle 19 are held together by axle 14 and pivot rod 13. Axle 14 proceeds through sized openings in the forward marginal end portion of members 20 and handle 19. A tight fit among axle 14, handle 19 and members 20 hold these portions in constant relation to one another. Adverting to FIG. 3, wheels 16 are journaled to portions of axle 14 extending above and below forward chassis portion 11.

Continuing to advert to FIG. 3, rearward chassis portion 12 comprises two identical, spaced members 21. Axle 15 proceeds through and forms a tight fit with sized openings in the rearward marginal end portion of members 21. Accordingly, members 21 move as one. Wheels 16 are journaled to portions of axle 15 extending above and below rearward chassis portion 12.

Chassis portions 11 and 12 are hingedly connected by pivot rod 13, described in greater detail below.

Adverting to FIGS. 1 and 2, container 18 replicates the container of a full-size dump truck. Container 18 rests on members 21. The walls and bottom of container 18 define a volume in which material is held. The rearward wall 22 has pegs 23 protruding from the upper marginal end portion of surface 24. Pegs 23 snap into recesses on the side walls of container 18. Pegs 23 are journaled in the container wall recesses providing free rotation of pegs 23 and wall 22.

Forward and rearward chassis portions 11 and 12 overlap at and rotate about pivot rod 13. Referring to FIG. 3, the left marginal end portion of members 21 have openings. The right marginal end portions of handle 19 and members 20 also have openings. The left marginal end portion of members 21 overlap the right marginal end portion of handle 19 and members 20. These openings register allowing pivot rod 13 to proceed therethrough. Handle 19 and members 20 and 21 are journaled on pivot rod 13 providing free rotation of chassis portions 11 and 12.

The rotation of chassis portions 11 and 12 is limited by rod-and-recess stop 25. Stop 25 comprises two parts, a rod 26, shown best in FIG. 3 as fixedly attached at the left marginal end portion of members 21, and a crescent shaped recess 28 at the right marginal end portion of members 20. Recess 28 is an arc of a circle having pivot rod 13 as its center. Rod 26 fits into recess 28 and slides within recess 28 as pivot rod 13 moves upward and downward.

FIG. 1 shows dump truck 10 in its transport position. In its transport position, dump truck 10 is capable of performing a first function, the movement of material held by container 18. A child grasps handle 19 with one hand and directs the movement of dump truck 10 by applying force. The transport position is defined by abutment of rod 26 with the right end recess 28.

FIG. 2 shows dump truck 10 in its dumping position. In its dumping position, dump truck 10 is capable of performing a second function, the dumping to material from container 18. The dumping position is defined by rod 26 abutting the left end of recess 28. In the dumping position, swinging wall 22 opens, allowing material inside container 18 to slide out.

Importantly, changing dump truck 10 from its transport position to its dumping position (or visa-versa) is counter-intuitive to a child. To lower the back end of dump truck 10, thus dumping material held by container 18, the child must rotate handle 19 about axle 14 in the counterclockwise direction, which the child will characterize as a "raising" action, an action opposite to the lowering he intends to effect.

A further benefit of the present invention is the ease of transition between transport and dumping positions by one hand and without the need for the child to change its grip. All functions are controlled with one hand using the same grip on handle 19. Accordingly, the child always has one hand free to manipulate other items and can quickly change between transport and dumping positions.

The hinged chassis can be adapted to emulate most any adult work vehicle. In a second embodiment, shown in FIGS. 4–5, the hinged chassis is utilized in a toy tow truck. Similar to dump truck 10, tow truck 30 comprises a forward chassis portion 31 having an integrated handle 32 and a rearward chassis portion 33 hinged together about a pivot rod 34, and a rod-and-recess stop 35. Instead of having a container, the work device of tow truck 30 is a boom 36 extending rearwardly from axle 38. Boom 36 has a notch 39 to hook items.

Figure 5:
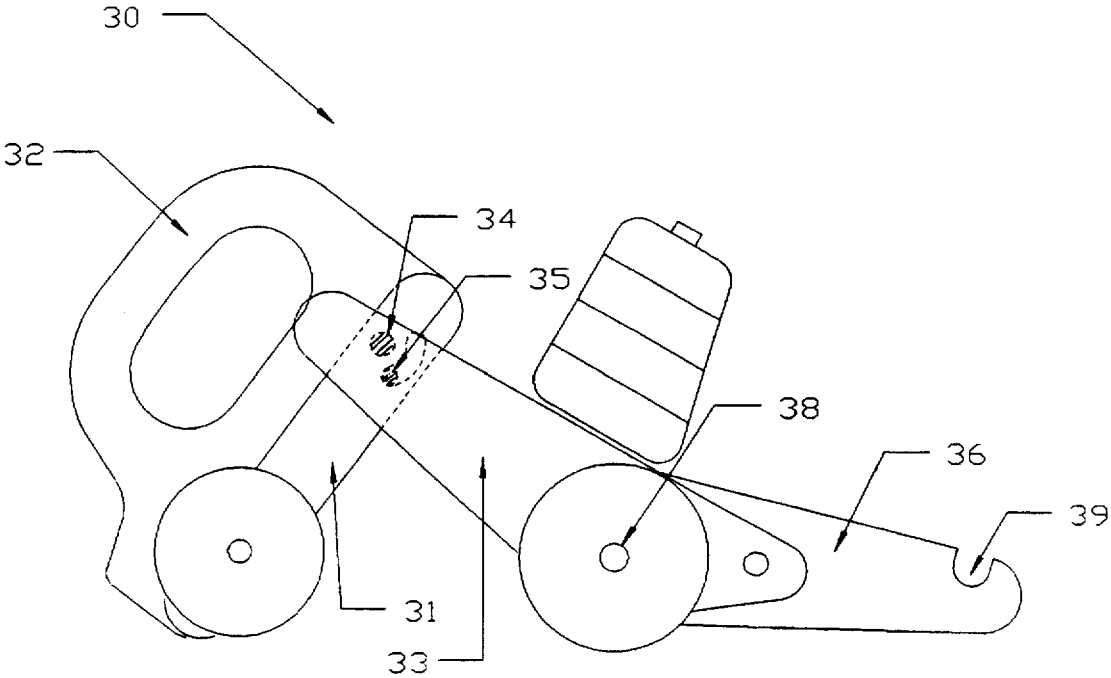
FIG. 5 is similar to FIG. 4 except the tow truck is shown in its loading position.

In its loading position, shown in FIG. 5, tow truck 30 is able to perform a first function, loading an item onto notch 39. In its loading position, boom 36 rests on or near the surface supporting tow truck 30 and can be slid under an item (e.g., a second vehicle) and notch 39 can be attached to a portion of that item.

Figure 4:
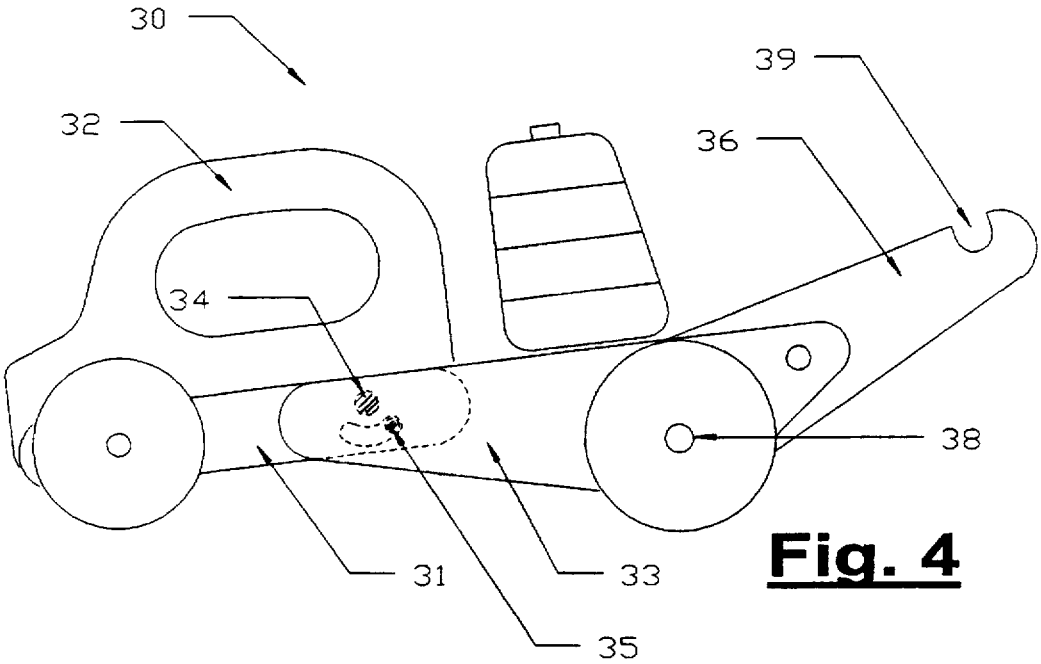
FIG. 4 is a side elevation, partially in section, of a tow truck in its towing position.

In FIG. 4, tow truck 30 is shown in its towing position whereby it can perform a second function, towing. Once the chosen item is attached to notch 39 in the loading position, tow truck 30 can be placed in its towing position using downward force on handle 32, thus raising a portion of the item.

Figure 6:
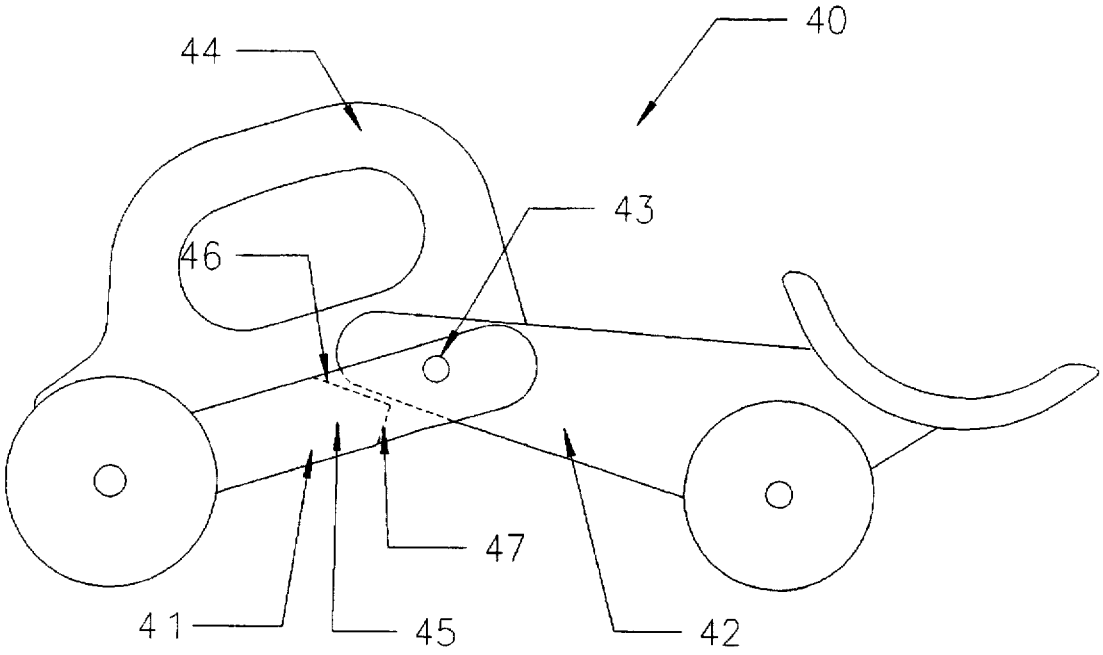
FIG. 6 is a side elevation, partially in section, of a toy bulldozer.
Figure 7:
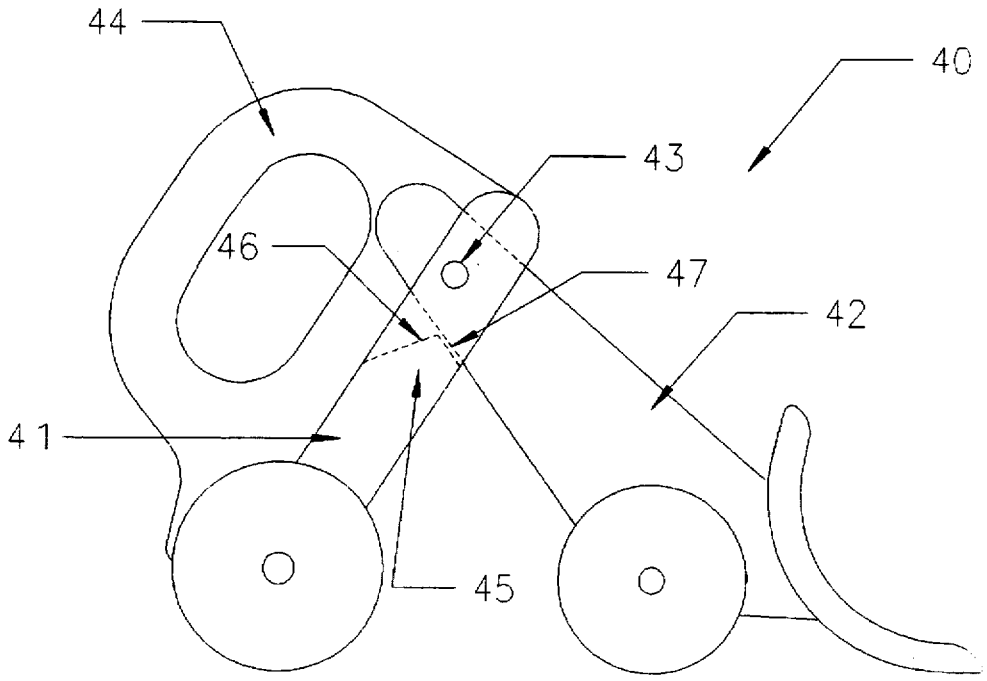
FIG. 7 is similar to FIG. 6 except the bulldozer is in its pushing position.

The instant invention contemplates the use of different stop devices to limit the movement of the hinge. FIGS. 6 and 7 show a toy bulldozer 40 constructed similar to dump truck 10 and tow truck 30. Bulldozer 40 has a forward chassis portion 41 and a rearward chassis portion 42 hinged about a pivot rod 43. A handle 44 is portion of rearward chassis portion 41. FIG. 6 shows bulldozer 40 in its transport position while FIG. 7 shows bulldozer 40 in its pushing position.

Unlike dump truck 10 and tow truck 30, the stop for bulldozer 40 is a triangular flange 45 having faces 46 and 47 on chassis portion 41. Upward motion of pivot rod 43 is limited by chassis portion 42 abutting face 47, which is shown in FIG. 7. Downward motion of pivot rod 43 is limited by chassis portion 42 abutting face 46, which is shown in FIG. 6.

Modifications

The invention is not limited to the previously disclosed embodiments. Upward and downward movement of pivot rod 13 could place the toy vehicle in more than two positions, each associated with emulating a function of an adult work vehicle. Further, more than one hinge along the chassis can be used to create a "caterpillar" type vehicle.

Figure 8:
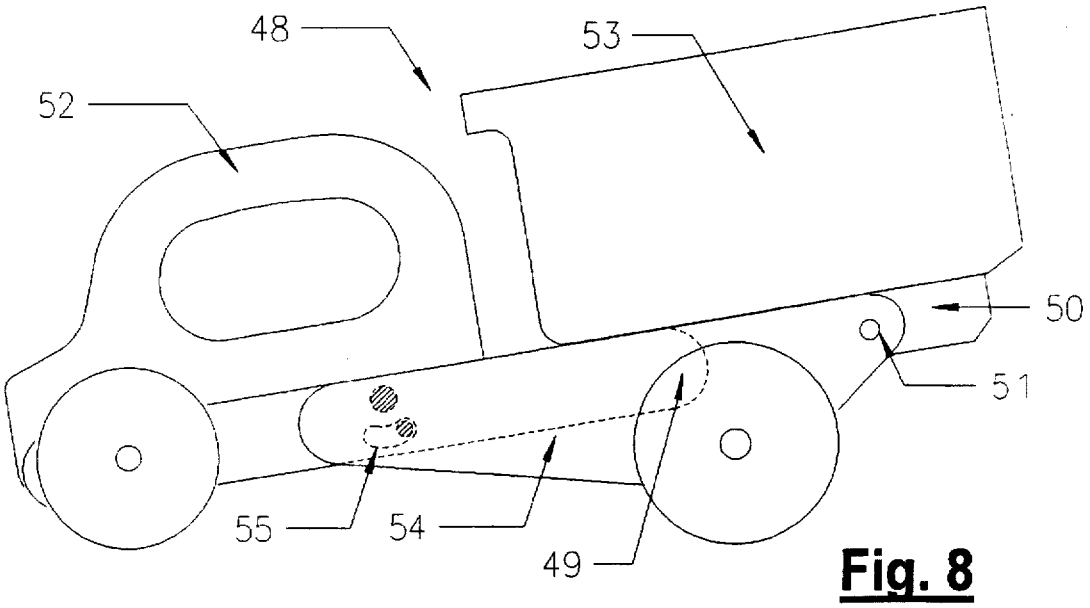
FIG. 8 is a side elevation, partially in section, of a toy dump truck having a specially configured handle.
Figure 9:
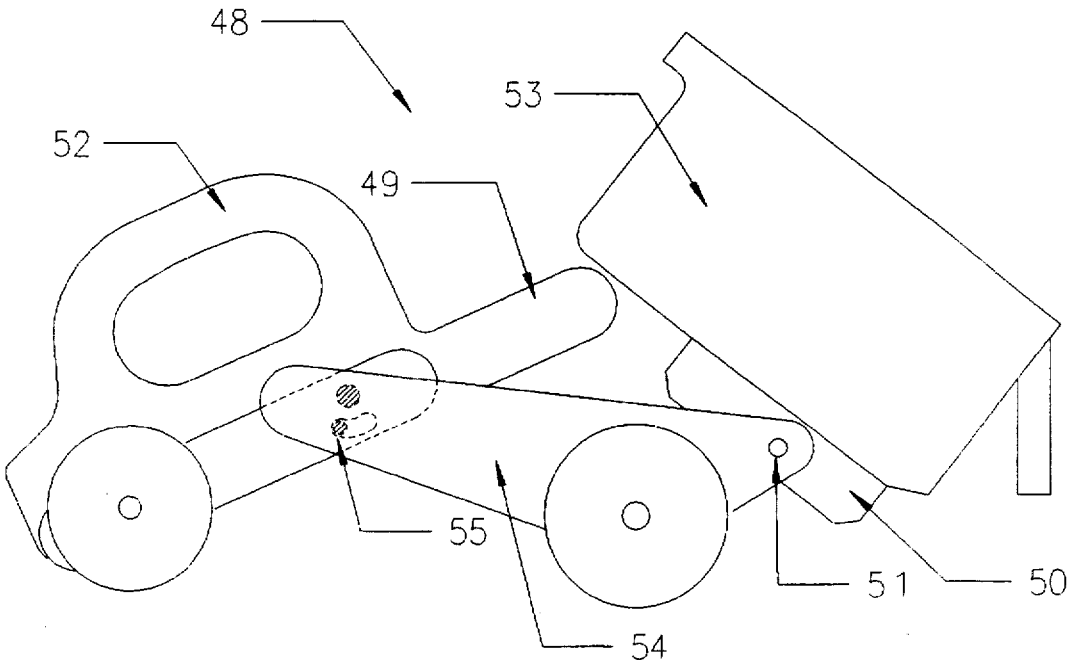
FIG. 9 is similar to FIG. 8 except the dump truck is in its dumping position.

The invention also contemplates the use of specially configured handles or chassis portions to provide extra mechanical advantage. FIGS. 8 and 9 show a dump truck 48 substantially the same as dump truck 10 except for the addition of handle extension 49, block 50 and pivot pin 51. In FIG. 8, extension 49 extends rightwardly from the handle 52, resting below container 53 when dump truck 48 is in its transport position. It is also contemplated to extend portions of the forward chassis portion to perform the functions of extension 49. Block 50 is mounted to the bottom of container 53 between the arms of rearward chassis portion 54. Block 50 is journaled on pivot pin 51. Accordingly, both block 50 and container 53 are free to rotate about pivot pin 51.

When dump truck 48 is moved from its transport position, shown in FIG. 8, to its dumping position, shown in FIG. 9, extension 49 rotates in the counterclockwise direction causing container 53 to rotate about pivot pin 51 in the clockwise direction at a greater angular rate than the rotation of rearward chassis portion 54 about hinge 55 in the clockwise direction. Thus, container 53 of dump truck 48 reaches its dumping position after a smaller angular rotation about its hinge than in dump truck 10.

Figure 10:
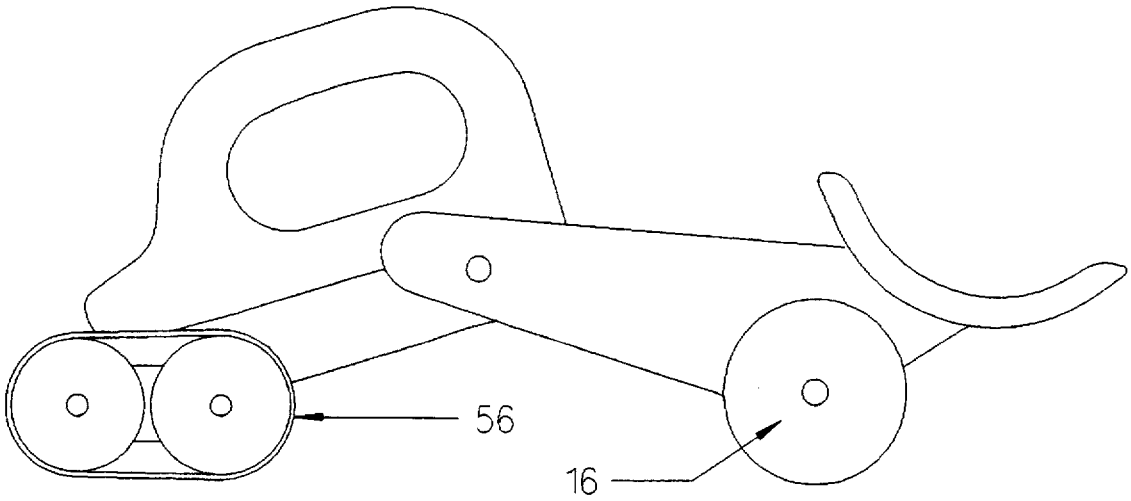
FIG. 10 is a side elevation of a toy bulldozer of the invention having both tracks and wheels.
Figure 11:
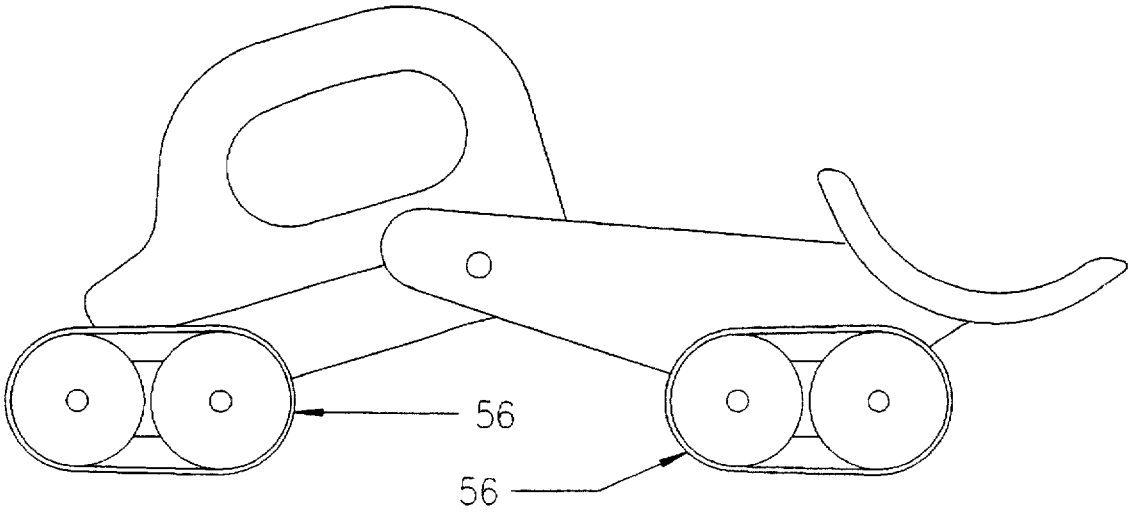
FIG. 11 is a side elevation of a toy bulldozer of the invention having tracks.

Also, the toy vehicle need not be supported by wheels. As shown in FIGS. 10 and 11, track-type treads 56, or a mix of wheels 16 and treads 56 could be used.

Therefore, while preferred forms of the toy vehicle have been shown and described, and various changes in modifications therein discussed, persons skilled in this art will readily appreciate the various additional changes and modifications may be made without departing from the spirit of the invention, as defined and differentiated by the following claims.

We claim:

1. A toy dumptruck comprising:

a chassis having at least first and second articulated members joined by a hinge, said chassis having supports at a plurality of locations, and all forces acting on one of said first and second members which transfer to the other of said first and second members transfer through said hinge;

a container mounted to said chassis, said chassis adapted to carry material as a first function and adapted to dump said material as a second function;

said hinge configured to move substantially vertically through a first position and a second position; and said first function operable when said hinge is in said first position and said second function operable when said hinge is in said second position.

2. The dumptruck described in claim 1 further comprising a handle configured to manipulate said movement of said hinge wherein said container is mounted on a pivot to said chassis, and said handle includes an extension configured to rotate said container about said pivot at an angular rate faster than the angular rate of rotation of said chassis when said hinge moves from said first position to said second position.

3. The dumptruck described in claim 1 further comprising a handle configured to manipulate said movemeut of said hinge wherein said container is mounted on a pivot to said chassis, and one of said first and second members includes an extension configured to rotate said container about said pivot at an angular rate faster than the angular rate of rotation of said chassis when said hinge moves from said first position to second position.

4. The dumptruck described in claim 1 wherein said chassis has a plurality of hinges.

5. The dumptruck described in claim 1 wherein said supports are wheels.

6. The dumptruck described in claim 1 wherein said supports are tracks.

7. The dumptruck described in claim 1 wherein said supports are a combination of wheels and tracks.

8. The dumptruck described in claim 1 wherein said first and second members are of unequal length.

9. The dumptruck described in claim 1 further comprising a handle mounted to one of said first and second members adapted to manipulate said hinge.

10. A toy bulldozer comprising:

a chassis having at least first and second articulated members joined by a hinge, said chassis having supports at a plurality of locations, and all forces acting on one of said first and second members which transfer to the other of said first and second members transfer through said hinge;

a blade mounted to said chassis, said blade adapted to push material as a first function and to carry material as a second function;

said hinge configured to move substantially vertically through a first position and a second position; and said first function operable when said hinge is in said first position and said second function operable when said hinge is in said second position.

11. The bulldozer described in claim 10 wherein said chassis as a plurality of hinges.

12. The bulldozer described in claim 10 wherein said supports are wheels.

13. The bulldozer described in claim 10 wherein said supports are tracks.

14. The bulldozer described in claim 10 wherein said supports are a combination of wheels and tracks.

15. The bulldozer described in claim 10 wherein said first and second members are of unequal length.

16. The bulldozer described in claim 10 further comprising a handle mounted to one of said first and second members adapted to manipulate said hinge.

17. A vehicle comprising a chassis having at least first and second articulated members joined by a hinge, said chassis having supports at a plurality of locations, and all forces acting on one of said first and second members which transfer to the other of said first and second members transferring through said hinge;

a work device mounted to said chassis, said work device having first and second functions;

said hinge configured to move substantially vertically through a first position and a second position;

said first function operable when said hinge is in said first position and said second function operable when said hinge is in said second position; and a recess in said first member and a rod mounted to said second member configured to slidably engage said recess to limit the movement of said hinge between minimum and maximum positions;

whereby the movement of said hinge from said minimum position to said maximum position slides said rod from one end of said recess to the other end of said recess.

18. A vehicle comprising a chassis having at least first and second articulated members joined by a hinge, said chassis having supports at a plurality of locations, and all forces acting on one of said first and second members which transfer to the other of said first and second members transferring through said hinge;

a work device mounted to said chassis said work device having first and second functions;

said hinge configured to move substantially vertically through a first position and a second position;

said first function operable when said hinge is in said first position and said second function operable when said hinge is in said second position; and said hinge comprises a pivot rod passing through the rearward end portion of said first member and the forward end portion of said second member;

a flange having at least first and second facets on one of said first and second members configured to limit the movement of said hinge between minimum and maximum positions such that when said hinge is in said minimum position the one of said first and second members not having said facets abuts said first facet such that further downward movement of said hinge past said minimum position is prevented, and when said hinge is in said maximum position the one of said members not having said facets abuts said second facet such that further upward movement of said hinge past said maximum position is prevented.

* * * * *